US006230882B1

(12) United States Patent
Wischusen, III

(10) Patent No.: US 6,230,882 B1
(45) Date of Patent: May 15, 2001

(54) CARRIER FOR DRINK CUPS

(75) Inventor: Henry Wischusen, III, Lilburn, GA (US)

(73) Assignee: Rock-Tenn Company, Norcross, GA (US)

( * ) Notice: Subject to any disclaimer, the term of this patent is extended or adjusted under 35 U.S.C. 154(b) by 0 days.

(21) Appl. No.: 09/392,086

(22) Filed: Sep. 8, 1999

(51) Int. Cl.[7] ..... B65D 75/00; B65D 85/44

(52) U.S. Cl. ..... 206/194; 206/183; 206/426

(58) Field of Search ..... 206/162, 163, 206/170, 174, 175, 180, 183, 185, 194, 427, 426; 294/87.2

(56) References Cited

U.S. PATENT DOCUMENTS

| | | | | |
|---|---|---|---|---|
| D. 198,481 | | 6/1964 | Koolnis . | |
| 2,134,627 | | 10/1938 | Turner . | |
| 2,160,550 | | 5/1939 | Lupton . | |
| 2,304,683 | | 12/1942 | Finn et al. . | |
| 2,324,771 | | 7/1943 | Fiore . | |
| 2,339,278 | | 1/1944 | Lyons, Jr. . | |
| 2,421,850 | * | 6/1947 | Ringler | 206/194 X |
| 2,558,715 | | 6/1951 | Williamson . | |
| 2,563,065 | | 8/1951 | Price . | |
| 2,609,981 | * | 9/1952 | Bolding | 206/194 X |
| 2,701,661 | | 2/1955 | Murray . | |
| 2,802,597 | * | 8/1957 | Davis | 206/183 X |
| 2,946,436 | | 7/1960 | Williamson . | |
| 2,967,003 | | 1/1961 | Forrer et al. . | |
| 3,069,979 | | 12/1962 | Charles et al. . | |
| 3,249,254 | | 5/1966 | Forrer . | |
| 3,565,323 | | 2/1971 | Katzenmeyer . | |
| 3,744,704 | * | 7/1973 | Struble | 206/194 |
| 3,773,214 | | 11/1973 | Lemon . | |
| 3,780,906 | | 12/1973 | Katzenmeyer . | |
| 4,155,502 | | 5/1979 | Forte . | |
| 4,196,807 | | 4/1980 | Brom . | |
| 4,201,322 | * | 5/1980 | Crawford | 206/183 |
| 5,624,024 | | 4/1997 | Miess . | |

FOREIGN PATENT DOCUMENTS

| | | |
|---|---|---|
| 162647 | 4/1955 | (AU) . |
| 1176896 | 4/1959 | (FR) . |
| 1185620 | 8/1959 | (FR) . |

* cited by examiner

*Primary Examiner*—Byron P. Gehman
(74) *Attorney, Agent, or Firm*—Kilpatrick Stockton LLP

(57) ABSTRACT

A carrier with internal support members for carrying multiple beverage containers. The carrier is formed from foldable material that can quickly and easily be erected and loaded with beverage containers. The internal support structure of the carrier comprises central support tabs extending from the top panels connected to bottom support tabs extending from the bottom panels. The internal support structure gives the carrier the tensile strength needed to support multiple beverage containers. Arcuate support members restrain the top portions of the beverage containers from lateral movement. The bottom support members straddle the beverage containers and restrain the bottom portions of the beverage containers from lateral movement. The elongated central support tabs extend slightly into the beverage container receptacles creating a flexure fit when loading beverage containers into the carrier. External support braces are positionable to hold the carrier open during loading.

22 Claims, 11 Drawing Sheets

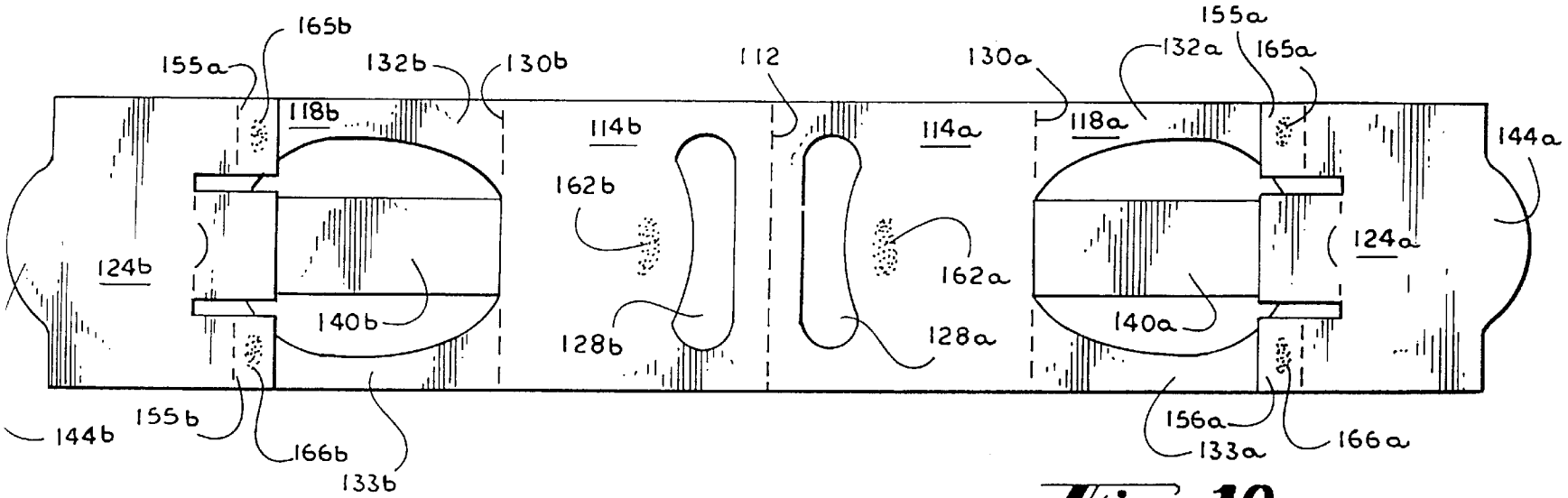
FIG. 10
FIG. 11
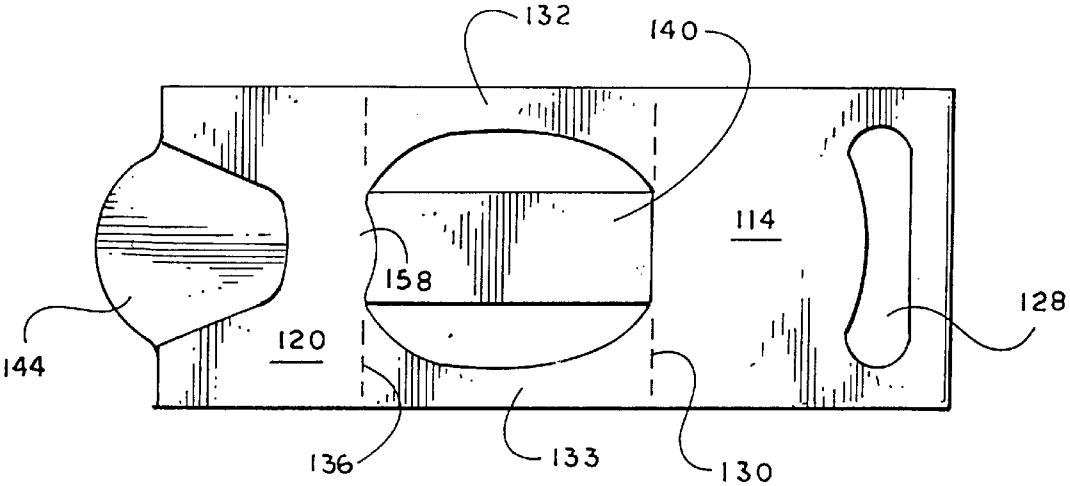

CARRIER FOR DRINK CUPS

FIELD OF THE INVENTION

The present invention relates to carriers for beverage containers, and more particularly relates to a foldable carrier with internal support members for carrying multiple beverage containers.

BACKGROUND OF THE INVENTION

In recent years, a variety of beverage container carriers have been developed to aid consumers. These carriers are often seen at stadiums and amusement parks when a single customer orders multiple drinks and must transport them to his/her companions. Another common use for these carriers is at the ever popular drive-through window of fast food restaurants. Beverage containers placed in a carrier are less likely to spill and soil the vehicle's interior. A typical carrier may often include a paperboard box with several receptacles for beverage containers.

A paperboard carrier for carrying beverage containers, such as disposable bottles, is disclosed in U.S. Pat. No. 2,967,003. The carrier is foldable and is constructed from a single blank. The beverage container receptacles restrain the top portion of the bottles from lateral movement.

U.S. Pat. No. 3,565,323 discloses a paperboard carrier for drink cups. The carrier is made from a single blank. Cups placed in the carrier are supported from the bottom and restrained laterally at the top of the receptacles.

Another carrier for drink cups is shown in U.S. Pat. No. 3,780,906. The carrier is foldable and has multiple drink receptacles. Partition panels extend from the top of the carrier all the way to the bottom in each receptacle. The partition panels are formed of material from an upper panel of the carrier. This limits the size of the upper panel and also the size of the receptacle opening in the upper panel.

In the previously described carriers, the beverage containers placed in the carriers are only restrained from movement in a direction parallel to the center line of the carriers at the top of the receptacles. There is no means for restraining movement of the bottom portion of the beverage containers in this direction. Additionally, these carriers do not provide a pressure or flexure fit for the beverage container. This increases the likelihood of the entire carrier tipping over and releasing the contents of the beverage containers. The partition panel which the cups rest on may disturb a cup that is completely full causing a spill. Also, the entire bottom panels of these carriers are solid and the interior support of the carrier extends downward from the upper panels all the way to the bottom of the carriers.

There is a need in the art for a carrier for beverage containers, formed from a foldable blank, that can be quickly and efficiently erected and loaded. There is a further need for a carrier that restrains beverage containers from movement in a direction parallel to the longitudinal center line of the carrier, both at the top and bottom of the beverage containers. There is still a further need in the art for a carrier that provides a flexure fit for beverage containers placed in the carrier. There is still a further need in the art for a carrier that provides internal support extending upward from the bottom of the carrier, requiring less material for the bottom surface of the carrier.

SUMMARY OF THE INVENTION

The present invention seeks to provide a foldable carrier that can be quickly and easily erected and loaded with beverage containers. The present invention also seeks to provide a carrier that restrains beverage containers from movement in a direction parallel to a longitudinal center line of the carrier, both at the top and bottom of the beverage containers. The present invention seeks to provide bottom support legs formed of material from a bottom surface of the carrier extending upward from the bottom of the carrier; this reduces the amount of material needed to construct the carrier. The present invention also seeks to provide central support tabs formed of material from upper panels of the carrier. The present invention also seeks to provide a flexure fit for beverage containers placed in the carrier to further ensure stability of the loaded carrier. The present invention further seeks to provide a single carrier for beverage containers that can easily be split into multiple carriers.

The present invention accomplishes these objects by providing a carrier having a plurality of receptacles with internal support members positioned to straddle containers placed in the receptacles. The invention provides arcuate support members that restrain the top portion of the containers from movement in a direction parallel to a longitudinal center line of the carrier and internal support members that restrain the bottom portion of the containers from movement in a direction parallel to the longitudinal center line of the carrier. The internal support members may comprise central support tabs formed of material from upper panels of the carrier and bottom support legs formed of material from a bottom surface of the carrier. The central support tabs extend from the upper panels towards side walls of the carrier. By using excess material from the upper panels and bottom surface to provide the internal structure of the carrier, this reduces the amount of material needed for the carrier. The central support tabs extend slightly into the interior of the receptacles creating a flexure fit when containers are loaded in the carrier. A longitudinal cut line allows a user to split the carrier into multiple smaller carriers.

Generally described, a first embodiment of the present invention provides a carrier comprising a sleeve having a plurality of upper panels. The upper panels are connected to a plurality of side walls which comprise a plurality of receptacles located in the upper panels on opposite sides of a longitudinal center line of the sleeve. A bottom surface is connected to the side walls. A plurality of internal support members extend from the upper panels to the bottom surface at an angle towards the side panels. The internal support members straddle the containers placed in the carrier. The internal support members may form a generally wishbone shape.

The present invention provides a carrier wherein each of the internal support members comprise a central support tab formed of material from the upper panels and bottom support legs formed of material from the bottom surface. The bottom support legs straddle a container placed in the carrier, restraining the container from movement in a direction substantially parallel to the longitudinal center line of the sleeve. The central support tab forms a tab head which engages the containers placed in the carrier forming a flexure fit and restraining the containers from movement in a direction perpendicular to the longitudinal center line of the sleeve.

The present invention also provides a carrier with each of the upper panels defining arcuate support members on each side of the receptacles, further restraining the containers from movement in a direction substantially parallel to the longitudinal center line of the sleeve. The arcuate support members have a first and second end which are wider than other points between the first and second ends to resist torque.

The present invention also provides a carrier with a handle panel, including a handle opening, attached to the upper panels. The bottom of the handle opening is curved to prevent engagement with a lid covering the container when loading the carrier. The side panels of the carrier include a plurality of support tabs foldably connected to the side panels. The support tabs engage the bottom panels to provide structural stability to the carrier. A vertical cut line between adjacent beverage container receptacles allows a user to break the carrier along the cut line producing multiple carriers.

The present invention also provides a carrier wherein the internal support members provide tensile strength to the carrier. The bottom surface provides compression strength to the carrier.

Thus, it is an object of the present invention to provide a carrier that can be constructed from a blank and that is easy to erect and load.

It is another object of the present invention to provide a carrier that restrains beverage containers placed in the carrier from movement in a direction parallel to a longitudinal center line of the carrier, both at the top and bottom of the beverage containers.

It is still another object of the present invention to provide bottom support legs formed of material from the bottom surface of the carrier, reducing the amount of material needed to construct the carrier.

It is yet another object of the present invention to provide a flexure fit for beverage containers placed in the carrier further ensuring stability of the loaded carrier.

It is still another object of the present invention to provide a carrier with adequate tensile and compression strength to support the beverage containers placed in the carrier.

It is yet another object of the present invention to provide a single carrier for beverage containers that can easily be split into multiple carriers.

Other objects, features and advantages of the present invention will become apparent upon reading the following detailed description of the embodiments of the invention, when taken in conjunction with the accompanying drawings and the appended claims.

BRIEF DESCRIPTION OF THE DRAWINGS

FIG. 10 is a top plan view of a partially assembled carrier of FIG. 8.

FIG. 11 is a top plan view of a partially assembled carrier of FIG. 8.

DETAILED DESCRIPTION

Figure 1:
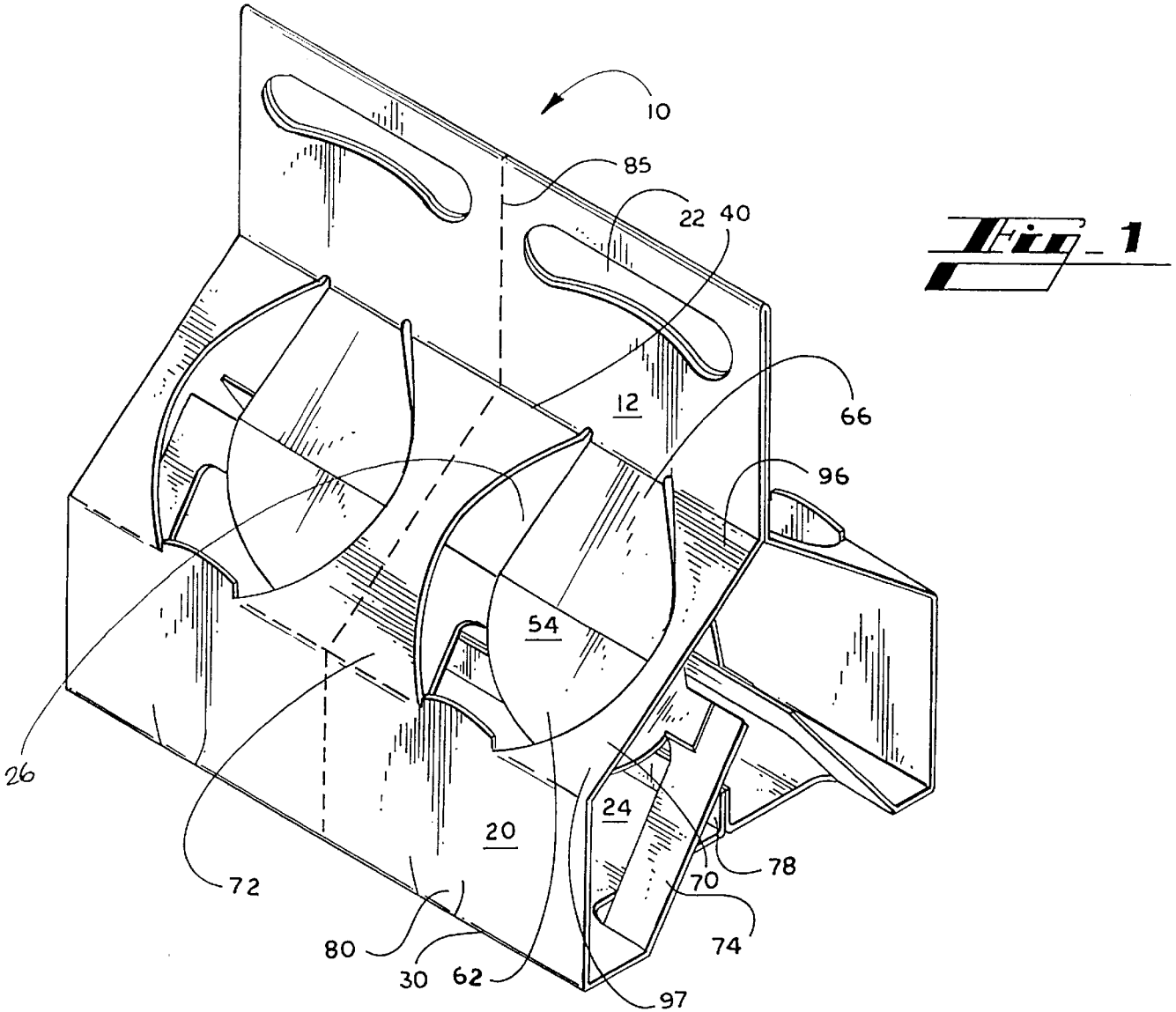
FIG. 1 is a pictorial view of an erected carrier.

Referring now in more detail to the drawings, in which like numerals refer to like parts throughout the several views, FIG. 1 shows a fully-erected carrier 10 of the present invention with handle openings 22 and beverage container receptacles 26.

Figure 2:
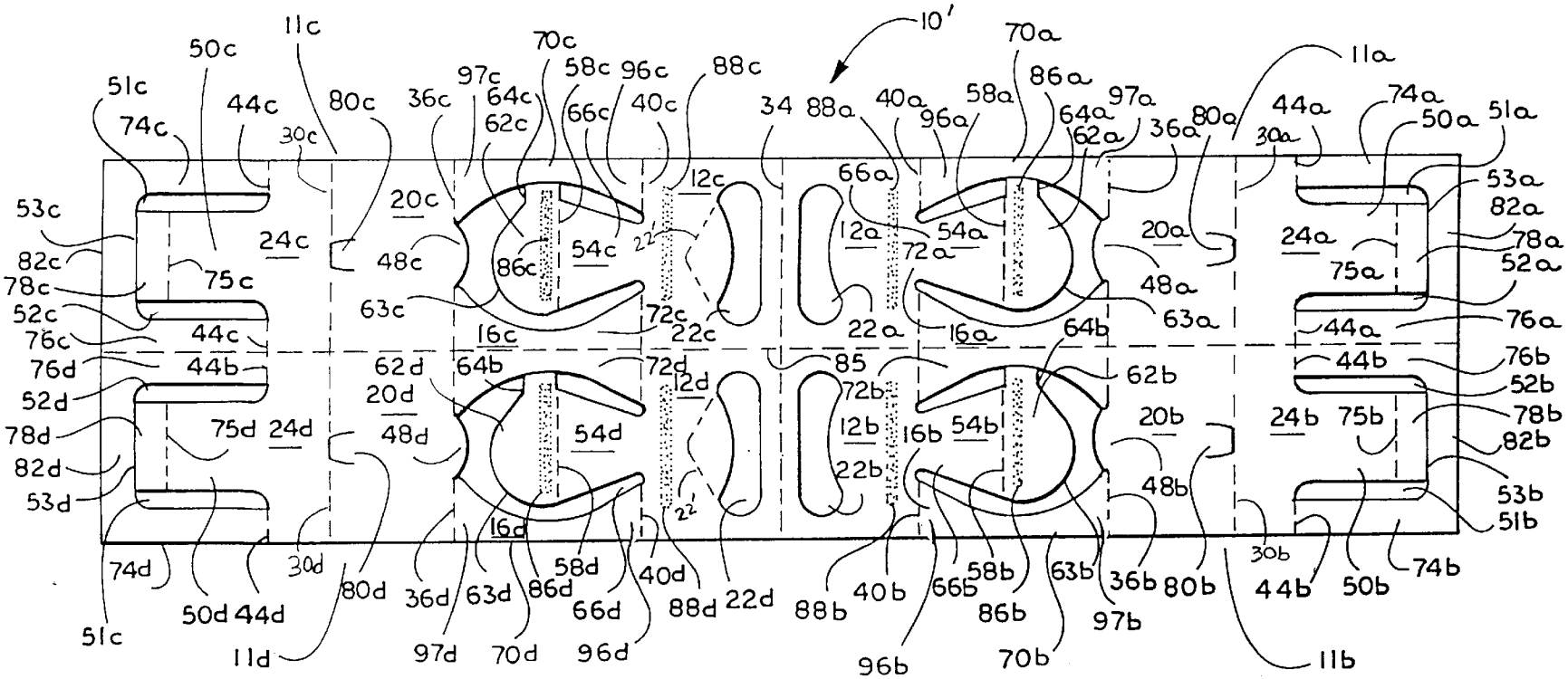
FIG. 2 is a top plan view of the interior surface of a blank from which the carrier embodying the present invention can be assembled.

The carrier 10 is constructed of a blank 10' of foldable sheet material, preferably conventional corrugated board, shown in FIG. 2. However, the carrier according to the present invention can be formed from any foldable and scorable material, such as solid paperboard.

Referring to FIG. 2, the carton blank 10' forms a large rectangle that can be divided into four substantially identical sections 11*a*, 11*b*, 11*c*, 11*d*. A vertical cut line 85 is located along the center of the blank 10' and separates section 11*a* from section 11*b* as well as section 11*c* from section 11*d*. A central fold line 34 is perpendicular to the cut line 85 and is located at the center of the blank 10'. The central fold line 34 separates blank carrier sections 11*a* from 11*c* and section 11*b* from section 1*d*. The carrier blank 10' will be described with particular reference to section 11*a*. One skilled in the art will understand that an appropriate number of identical sections can be properly connected to form a blank corresponding to the number of beverages container receptacles 26 desired in the erected carrier 10.

Section 11*a* includes a handle panel 12*a* defined by a central fold line 34 and a discontinuous fold line 40*a*. The handle panel 12*a* is foldably connected to an upper panel 16*a* along the discontinuous fold line 40*a*. The upper panel is foldably connected to a side panel 20*a* along a fold line 36*a*. The side panel 20*a* is foldably connected to a bottom panel 24*a* along a fold line 30*a*.

Figure 15:
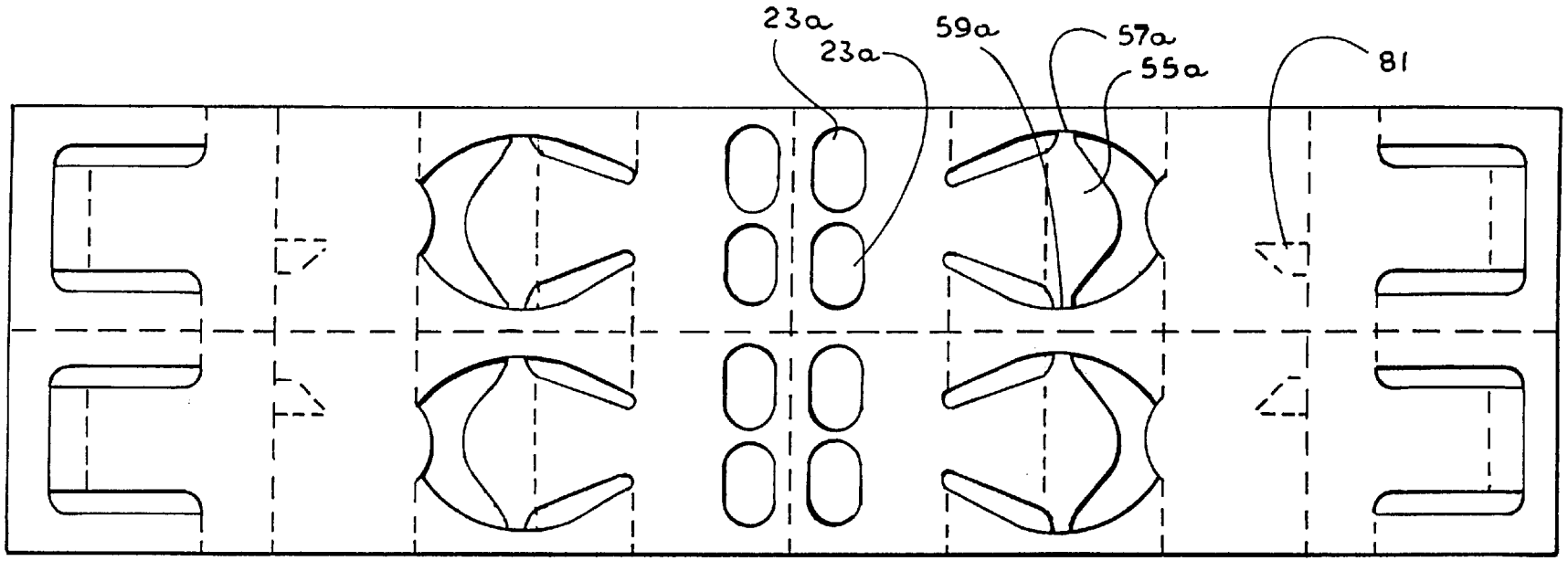
FIG. 15 is a top plan view of the interior surface of a blank from which a carrier embodying the present invention can be assembled.

The handle panel 12*a* has a handle opening 22*a* adjacent to the central fold line 34. The handle opening 22*a* is formed by a cutout section in the handle panel 12*a*. The details of the shape of the handle opening 22*a* will be described in further detail below. As shown in FIG. 15, the handle panel 12*a* may include multiple handle openings 23*a*, located adjacent to one another.

The handle panel 12*a* is connected to the upper panel 16*a* along the discontinuous fold line 40*a*, as shown in FIG. 2. A central support tab 54*a* is formed of material from the upper panel 16*a* and extends from the handle panel 12*a*. The central support tab 54*a* forms two portions, a tab neck 66*a* connected to the handle panel 12*a* and a tab head 62*a* foldably connected to the tab neck 66*a* along a tab fold line 58*a*. The tab neck 66*a* extends slightly beyond the discontinuous fold line 40*a* into the handle panel 12*a* in order to prevent the carrier 10 from tearing along the discontinuous fold line 40*a* when constructed. The tab neck 66*a* forms a trapezoid with the narrow end located along the discontinuous fold line 40*a* and the wider end located along the tab fold line 58*a*. The tab head 62*a* is somewhat elongated, having a curved portion 63*a* extending from a first end of the tab fold line 58*a* and a rectilinear portion 64*a* extending from the opposite end of the tab fold line 58*a*.

The cut out sections surrounding the central support tab 54*a* leave arcuate support members 70*a,* 72*a* in the upper panel 16*a,* extending from the handle panel 12*a* to the side panel 20*a,* on either side of the central support tab. The arcuate support members 70*a,* 72*a* define an opening through which a beverage container can be inserted when the carrier 10 is constructed and the central support tab 54*a* is folded out of the plane of the upper panel 16*a*. The arcuate support members 70*a,* 72*a* have a first end 96*a* and a second end 97*a* which are wider than other points between the first end 96*a* and the second end 97*a*. The thick ends of the arcuate support members 70*a,* 72*a* resist torque when the carrier 10 is fully erected and loaded with beverage containers.

In another embodiment of the present invention as shown in FIG. 15, the distal end of the tab head 55*a* is curved outwardly, towards the side panel 20*a*. The sides of the tab head 55*a* meet the arcuate support members 70*a,* 72*a* along the cut lines 57*a* and 59*a*.

As shown in FIG. 2, the upper panel 16*a* is connected to the side panel 20*a* along the fold line 36*a*. An extension tab 48*a* extends from the fold line 36*a* into the central support panel between the arcuate support members 70*a,* 72*a*. The extension tab 48*a* is curved and extends only slightly into the central support panel 16*a,* leaving a gap between the extension tab 48*a* and the tab head 62*a*.

The side panel 20*a* is connected to the bottom panel 24*a* along the fold line 30*a*. A support brace 80*a* is located in the center of side panel 20*a* adjacent to the fold line 30*a*. The support brace 80*a,* as shown in FIG. 2, is curved along the sides. Alternatively, the support brace 81, as shown in FIG. 15 may be trapezoidal. The function of the support brace 80*a* will be more clearly described below.

A bottom support tab 50*a* is defined in the center of the bottom panel 24*a* by a pair of longitudinal cutouts 51*a,* 52*a* and a transverse cut line 53*a*. The bottom support tab 50*a* is largely rectangular in shape. The bottom support tab 50*a* is surrounded by a U-shaped strut member having a pair of legs 74*a,* 76*a* on either side of the tab 50*a,* and a bottom strip 82*a,* which is separated from the tab 50*a* by the cut line 53*a*. A glue tab 78*a* is defined in the tab 50*a* by a tab fold line 75*a*. The glue tab 78*a* is rectangular in shape.

Figure 6:
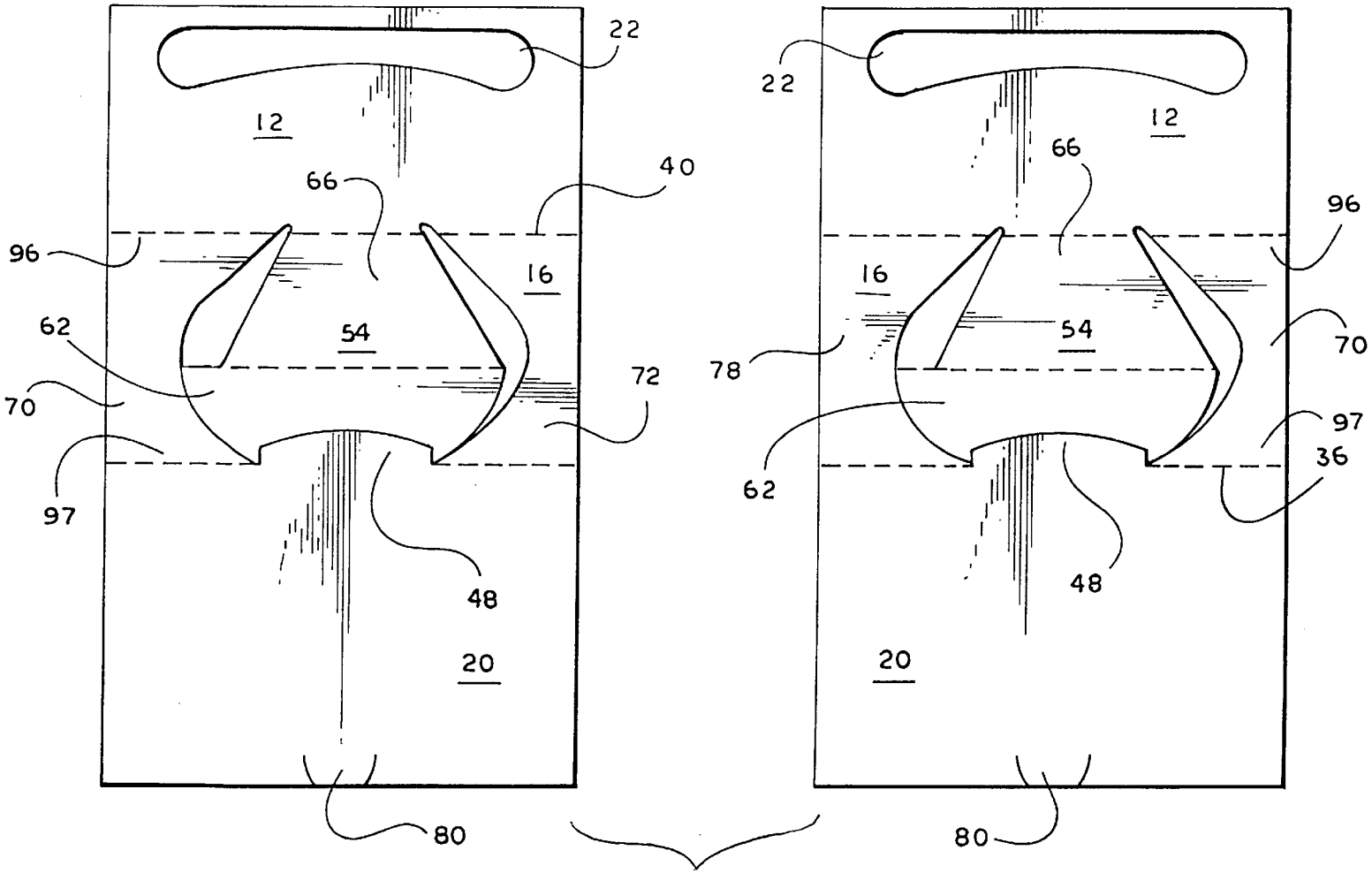
FIG. 6 is a front view of two carriers formed by splitting the single carrier of FIG. 1.

It should be understood that the fold lines 30, 34, 36, 40, 44 and the tab fold lines 58, 75 of the carrier 10 are perforated lines, with alternating small cut sections and solid sections, creating a flexible hinge along each line. The cut line 85 is an elongated perforation with much smaller solid intervals between adjacent cuts as is well known to those skilled in the art. This allows a user to split the carrier 10 apart, creating two smaller carriers, after bending along the score line 85, as shown in FIG. 6.

Assembly

In order to assemble the carrier, it is optional to pre-break the carrier blank 10' while it is flat as shown in FIG. 2. A user pre-breaks the carrier blank 10' by manually folding the carrier blank 10' along the fold lines 30, 34, 36 and the discontinuous fold lines 40, 44 as well as the tab fold lines 58, 75 until the carrier blank 10' is flexible along these fold lines.

Figure 3:
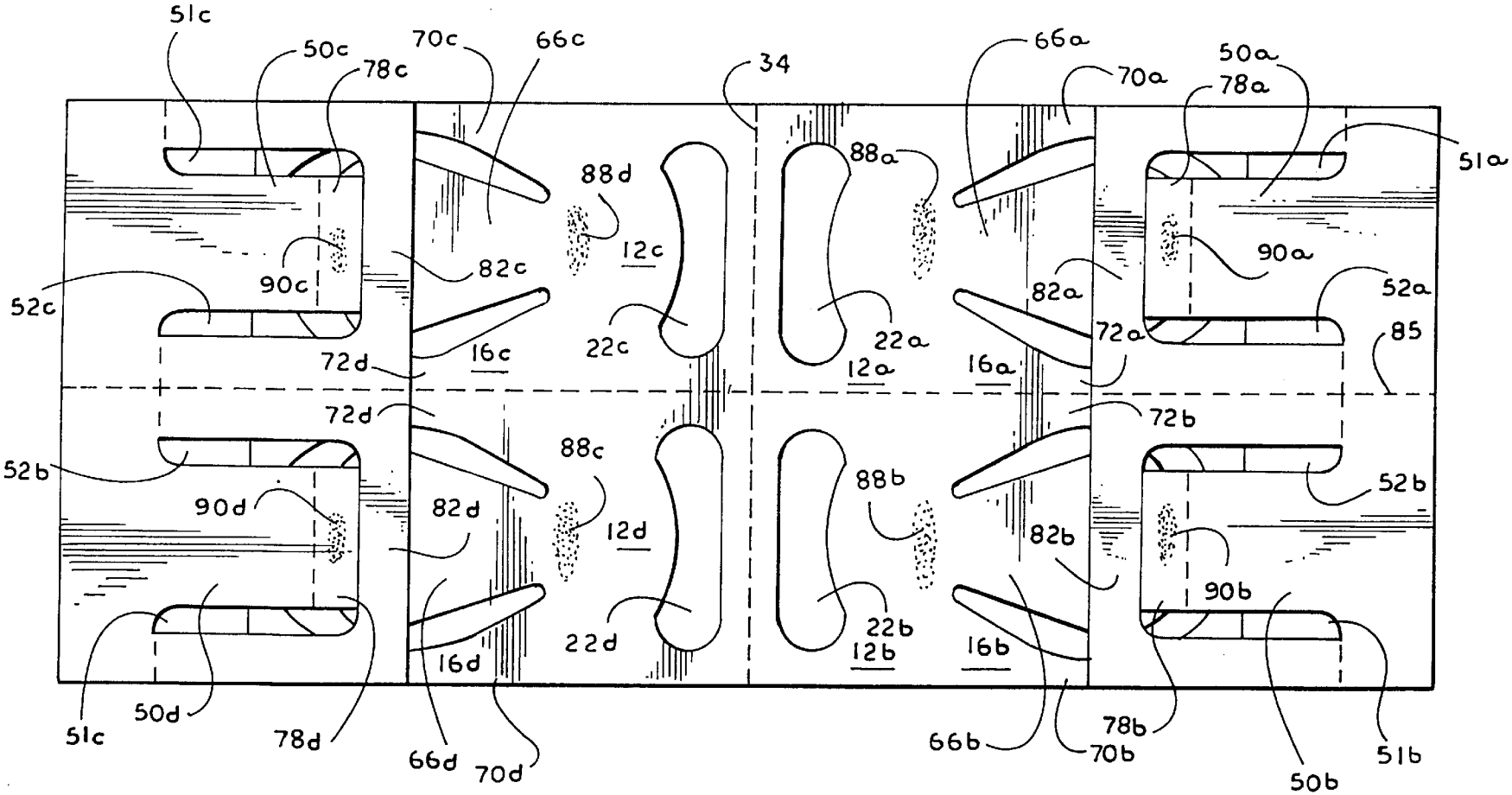
FIG. 3 is a top plan view of a partially assembled carrier embodying the present invention.

Referring now to FIGS. 2 and 3, the first step in the assembly process is to apply glue to glue areas 86*a, b, c, d.* The carrier blank 10' is folded along the fold lines 30*a, b, c, d* so that the bottom strips 82*a, b, c, d* are adhered to the respective central support tabs 54*a, b, c, d* by contacting the glue areas 86*a, b, c, d.*

Figure 4:
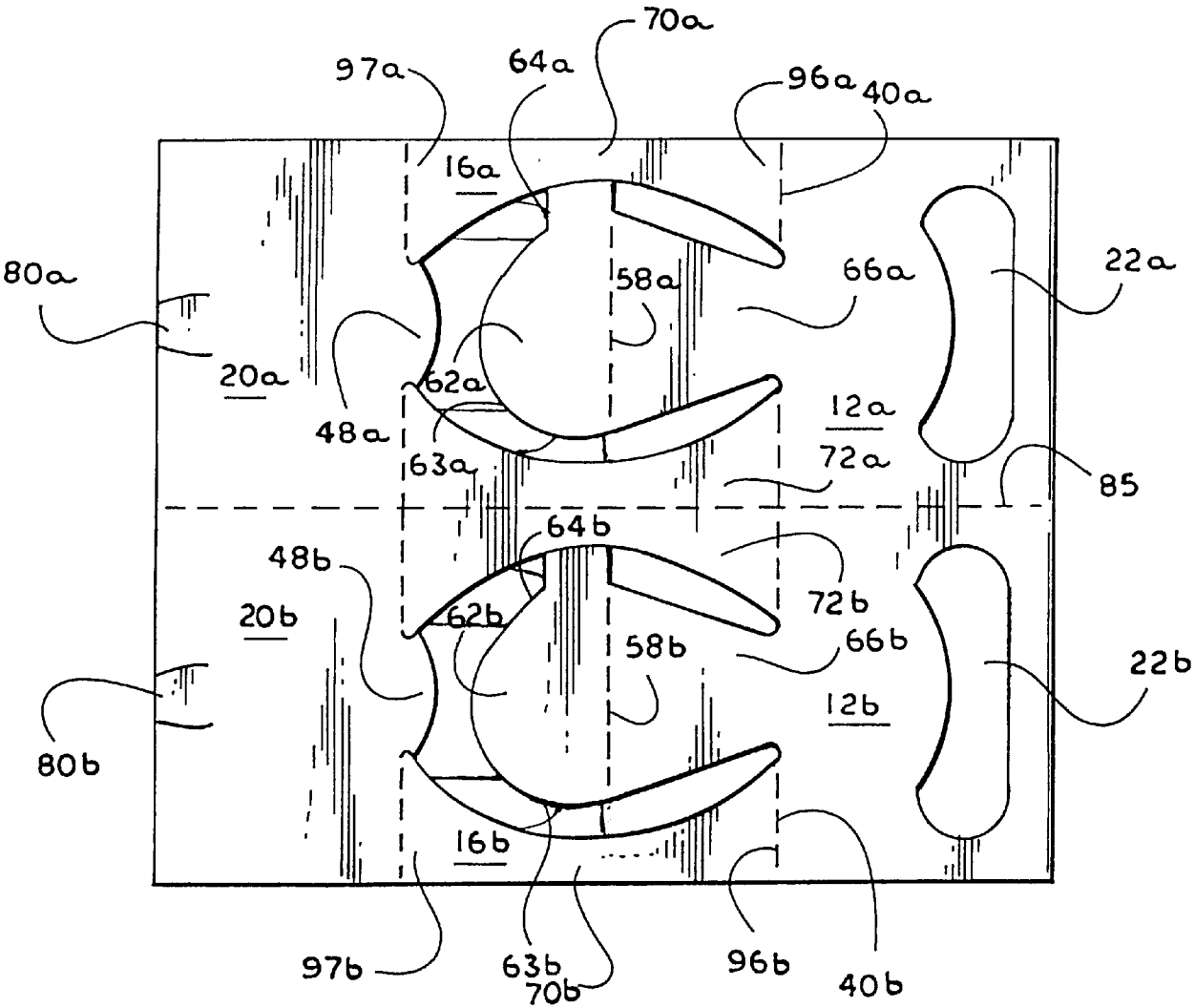
FIG. 4 is top plan view of a partially assembled carrier embodying the present invention.

Next, the glue is placed in glue areas 88*a, b, c, d* as well as glue areas 90*a, b, c, d,* as shown in FIG. 3. The glue areas 90*a, b, c, d* are located on the exposed portions of the glue tabs 78*a, b, c, d.* The carrier blank 10' is then folded along the central fold line 34. This results in the handle panel 12*a* adhering to the handle panel 12*c* and the handle panel 12*b* adhering to the handle panel 12*d,* as shown in FIG. 4. Folding the carrier blank 10' along the central fold line 34 also results in the glue tab 78*a* adhering to the glue tab 78*c* and the glue tab 78*b* adhering to the glue tab 78*d.* The resulting flat assembly, shown in FIG. 4, occupies very little space and therefore may be shipped efficiently to another location at which the carrier 10 may be erected and loaded.

Those skilled in the art will understand that automatic gluing and folding machinery using known techniques may be constructed to carry out this assembly in a mass production setting, but is not required to make the carrier 10 embodying the present invention.

Erecting and Loading the Carrier

The carrier 10 of FIG. 1 is constructed from the folded configuration shown in FIG. 4. The carrier is picked up by the handle opening 22 causing the adjacent bottom surfaces 24*a, b* to separate slightly from the opposing bottom surfaces 24*c, d.* The side panels 20*a, b* are pulled away from the opposite side panels 20*c, d* forcing the upper panels 16*a, b, c, d* outward along the discontinuous fold lines 40*a, b, c, d.* The central support tabs 54*a, b, c, d,* which are attached to the bottom strips 82*a, b, c, d,* are forced into the interior of the carrier 10. This forms the container receptacles 26 between the arcuate support members 70*a, b, c, d* and 72*a, b, c, d* of the upper panels 16*a, b, c, d.* The receptacles 26 extend downward into the carrier 10 and are further defined by the side panels 20*a* and the connection of the central support tab 54*a* with the U-shaped strut members formed by the legs 74*a, b, c, d,* 76*a, b, c, d,* and the bottom strip 82*a, b, c, d.* As the side panels 20*a, b, c, d* are pulled apart, the attachment of the glue tabs 78*a* to 78*c* and 78*b* to 78*d* causes the bottom support tabs 50*a, b, c, d* to move downward forming the bottom of the carrier 10.

The support braces 80 are then pressed inwards, into the interior of the carrier 10, so that they engage the bottom panel 24. This holds the unloaded carrier 10 open for easier loading. The carrier is then placed on a flat surface. In this configuration, the carrier 10 is erect and ready for loading.

To load the carrier 10, a beverage container 95 is placed in the receptacle 26. As the beverage container enters the carrier, the upwardly curved bottom portion of the handle opening 22 prevents a snap-on lid, covering a conventional beverage cup, from engaging the bottom edge of the handle opening 22 and de-lidding. This can also be achieved by configuring the handle opening 22 as an inverted triangle so that the bottom portion of the handle opening 22 is angled downward as shown by dotted line 22' in FIG. 2. It should be noted that the carrier 10 may be provided with a single centrally located handle opening 22, such that the handle opening is not vertically aligned with any of the receptacles 26. This placement of the handle opening 22 would not interfere with the snap on lids of the beverage containers 95.

Preferably, as the beverage container 95 is placed inside the carrier 10, the tab head 62 of the central support tab 54 engages the side of the beverage container creating a flexure fit. The tab head 62 preferably engages the beverage container 95 at a point below where the extension tab 48, located on the top of the side panel 20, engages the beverage container. This prevents the beverage container 95 from leaning out of the carrier 10 when the loaded carrier is lifted. The arcuate support members 70, 72 in the upper panel 16, surrounding the beverage receptacle 26, restrains the top portion of the beverage container from movement in a direction parallel to a longitudinal center line of the carrier 10.

Figure 5:
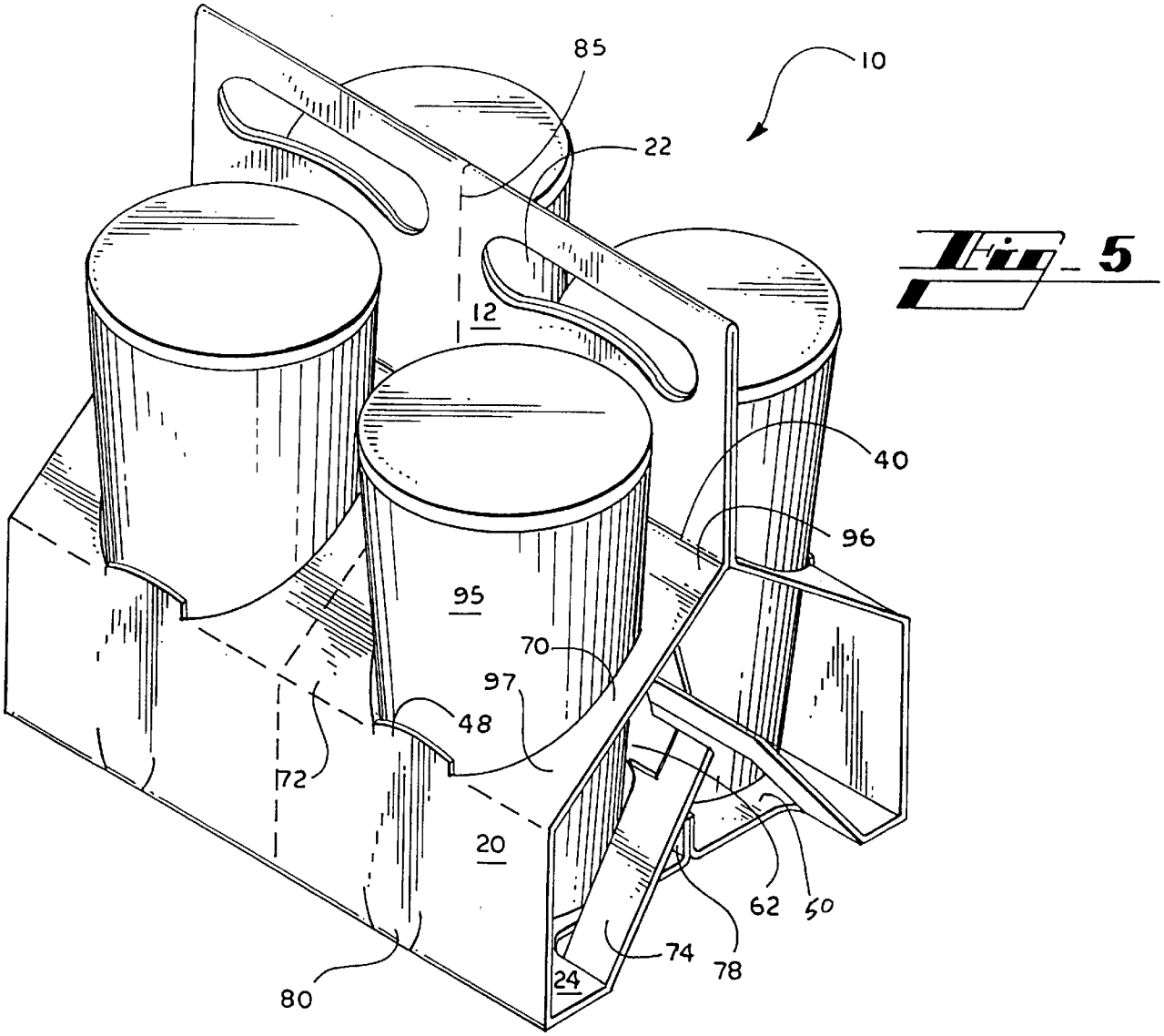
FIG. 5 is a pictorial view of a carrier embodying the present invention with beverage containers.

Once inside the carrier 10, the beverage container 95 rests on the bottom support tab 50 and the bottom panel 24, as shown in FIG. 5. The bottom support legs 74, 76 extend towards the central support tab 54, which is attached to the handle panel 12. The bottom support legs 74, 76 straddle the beverage container 95, further restraining the beverage container from movement in a direction parallel to the longitudinal center line of the carrier 10. It should be clear that the above described loading process can be repeated until all the beverage receptacles 26 are filled, if the user so chooses.

After loading the carrier 10, the carrier can be lifted off the flat surface using the handle openings 22. As the carrier supports the beverage containers 95, tensile forces are translated through the central support tabs 54 which are connected to the transverse support members 82 and the bottom support legs 74, 76. A small portion of the tensile forces may be translated through handle panels 12, the arcuate support members 70, 72 of the upper panels 16 and the side panels 20. The glue tabs 78 connect the bottom panels 24, which extend from the side panels 20 to the center of the carrier 10, preventing inward movement of the side panels.

Figure 14:
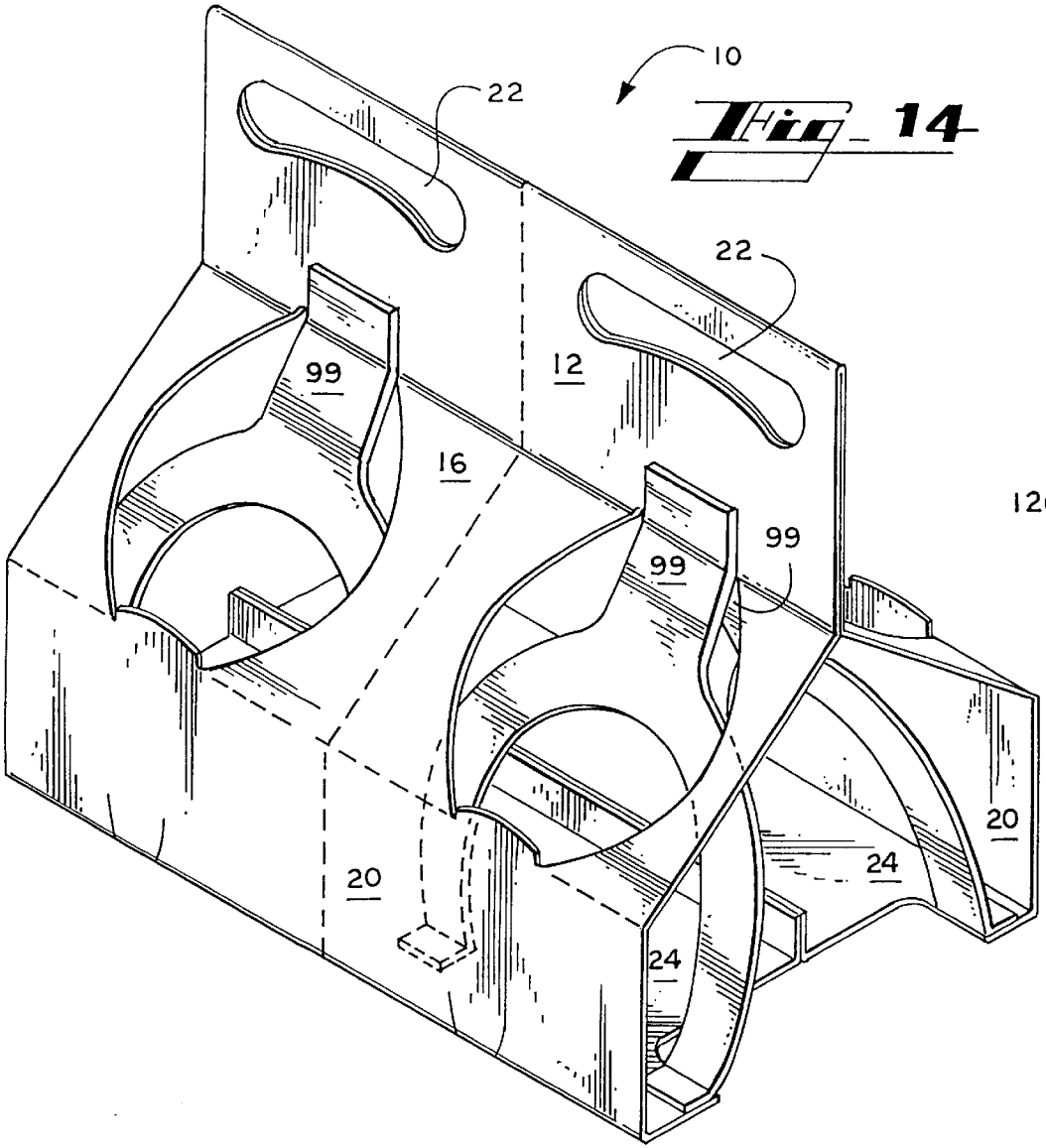
FIG. 14 is a pictorial view of a carrier embodying the present invention.

It should be understood that an internal support member 99 may extend at an angle from the upper panel 16 to the bottom surface 24, as shown in FIG. 14, in a direction towards the side panels 20 of the carrier 10. The internal support member 99, in the shape of a fork, straddles the beverage container 95 placed in the carrier 10. The internal support member 99 provides tensile strength for the carrier when loaded with beverage containers and lifted and also prevents movement of the beverage containers in a direction parallel to the longitudinal center line of the carrier 10.

The carrier 10 is provided with two handle openings 22. This allows a user holding the carrier by one handle opening 22 to pass the carrier to another user who can grab the carrier by the other handle opening 22, making the carrier easier to stabilize with one hand.

The carrier 10 may be divided into several carriers 10*a*, 10*b* as shown in FIG. 6. Prior to erecting the carrier 10, the flat assembled carrier can be bent back and forth along the cut line 85. This causes the carrier 10 to split into multiple carriers 10*a*, 10*b* which can then be erected and loaded as previously described. Those skilled in the art will understand that a user can divide the carrier to correspond to the appropriate number of beverage containers 95.

Alternate Embodiment

Figures 7, 9:
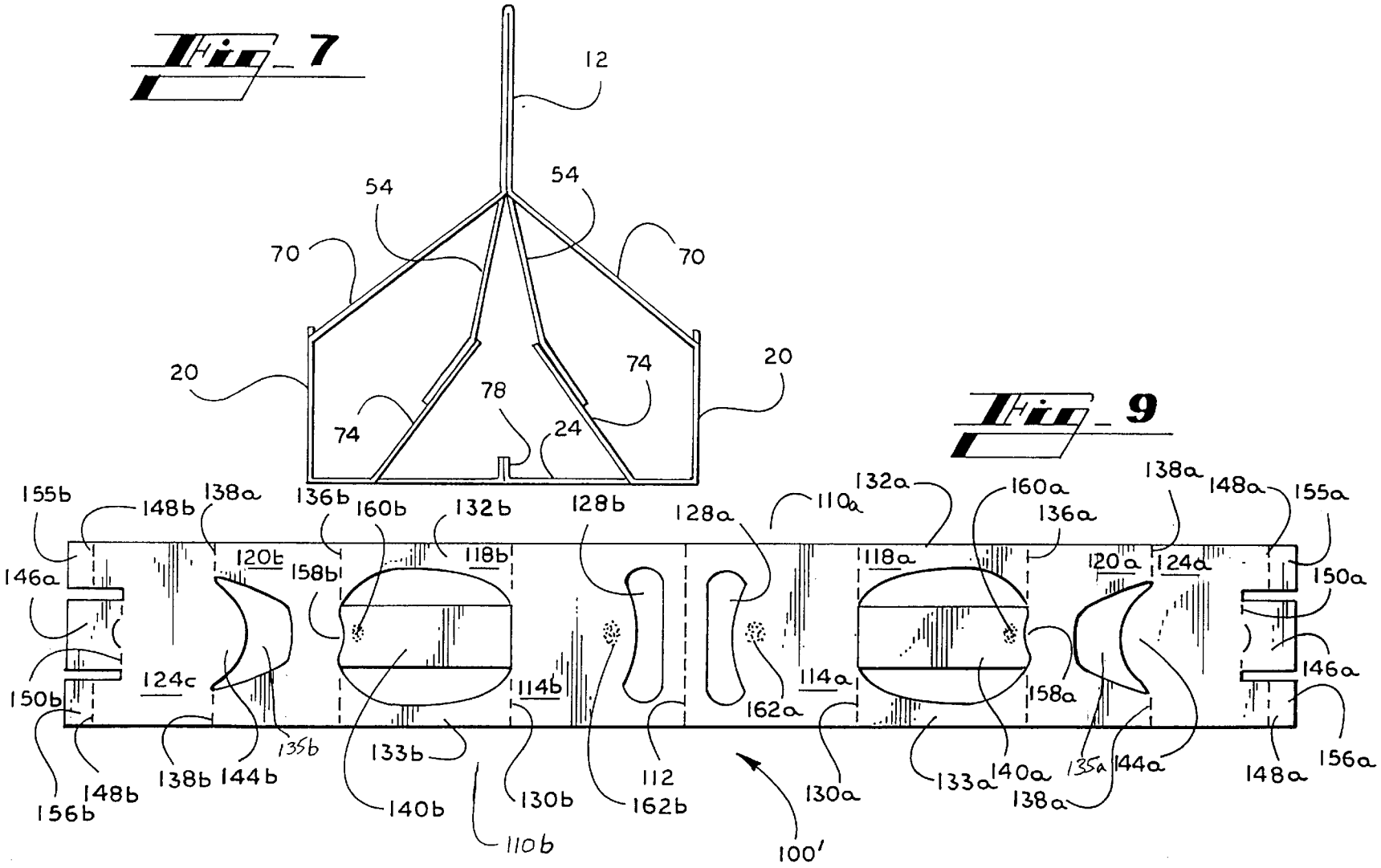
FIG. 7 is an end view of a carrier embodying the present invention.
FIG. 9 is a top plan view of the interior surface of a blank from which the carrier of FIG. 8 can be assembled.
Figure 8:
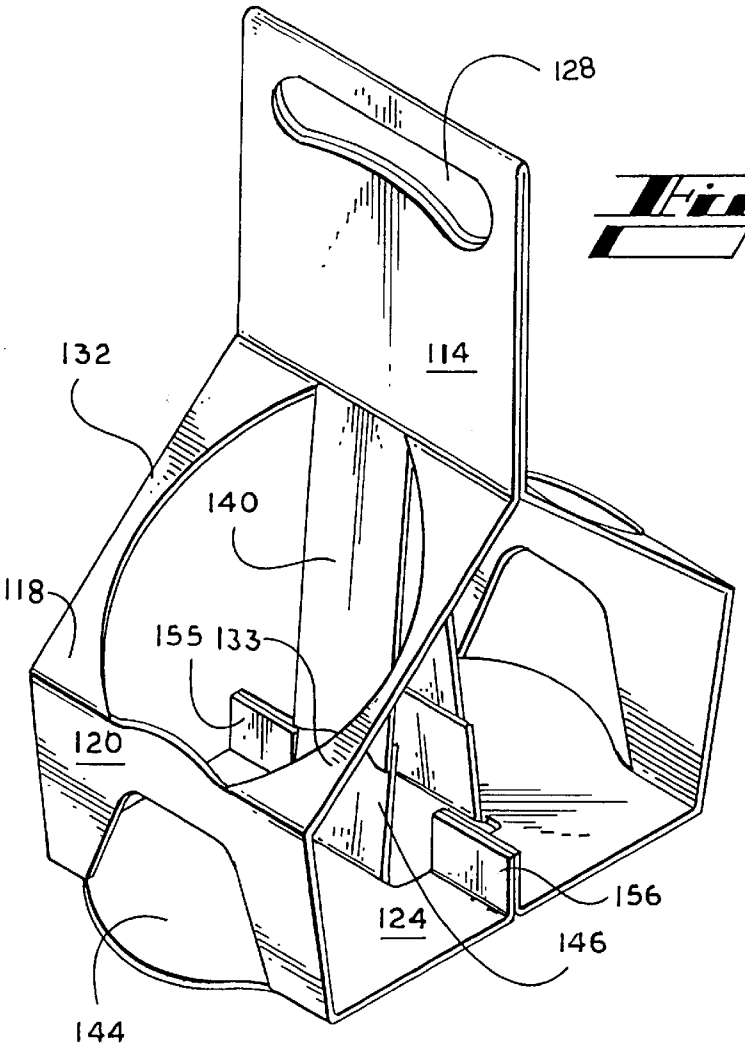
FIG. 8 is a pictorial view of an alternate embodiment of the present invention showing a fully-erected carrier.
Figure 13:
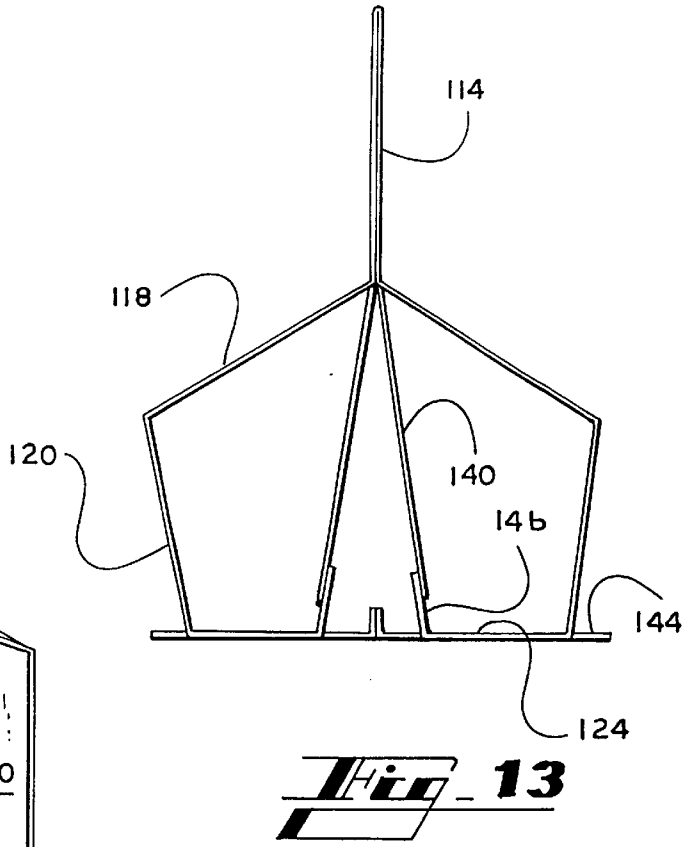
FIG. 13 is an end view of a carrier of FIG. 8.

A carrier 100 providing an alternate embodiment of the present invention may be constructed from a blank 100' as shown in FIG. 9. The blank 100' is similar to the blank 10' of the previous embodiment in that it can be made from conventional corrugated board or any foldable and scorable material such as solid paperboard. The blank 100' shown in FIG. 9, has two substantially identical sections 100*a* and 100*b* in order to form a carrier for two beverage containers 195 as shown in FIG. 8. Those skilled in the art will understand that a blank with multiple identical sections can be used to form a carrier for a larger number of beverage containers.

Referring to FIG. 9, the blank 100' forms two substantially identical sections 110*a*, 110*b* divided by a central fold line 112. The blank 100' will be described with particular reference to section 110*a*.

Section 110*a*, as shown in FIG. 9, includes a handle panel 114*a* defined by a central fold line 112 and a fold line 130*a*. The handle panel 114*a* is foldably connected to an upper panel 118*a* along the fold line 130*a*. The upper panel is foldably connected to a side panel 120*a* along a discontinuous fold line 136*a*. The side panel 120*a* is foldably connected to a bottom panel 124*a* along a fold line 138*a*.

The handle panel 114*a* includes a handle opening 128*a* located adjacent to the central fold line 112. The handle opening 128*a* is formed by a cut-out section in the blank 100'. The shape of the handle opening 128*a* is straight across the top and curved upwards along the bottom to prevent a container placed in the carrier from de-lidding as described above. The bottom portion of the handle opening 128*a* can also be angled downward to prevent interference with the beverage container lid.

The handle panel 114*a* is connected to the upper panel 118*a* along the fold line 130*a*. Portions of the upper panel 118*a* are cut away to form a central support strip 140*a*, extending longitudinally from the fold line 130*a* to or slightly beyond the fold line 130*a*, into the handle panel 114*a*, to prevent tearing along the fold line 130*a* when the carrier 100 is loaded. The central support tab 140*a* is largely rectangular with two parallel straight edges arranged perpendicular to the fold line 130*a*. However, the distal edge of the central support tab 140*a*, opposite the fold line 130*a*, is slightly curved inwardly to leave projecting material in the opposing side panel 120*a*. The cut out sections flanking the central support tab 140*a* leave arcuate support members 132*a*, 133*a* in the upper panel 118*a* on either side of the central support tab, and define an opening through which a beverage container 195 can be inserted after the carrier 100 is erected and the central support tab 140*a* is folded out of the plane of the upper panel. The thick ends of the arcuate support members 132*a*, 133*a* resist torque when the carrier 100' is fully erected and loaded with beverage containers.

The upper panel 118*a* is connected to the side panel 120*a* along the discontinuous fold line 136*a*. At the center of the fold line 136*a*, a cut line defines a curved extension tab 158*a* which extends from the side panel 120*a* into the upper panel 118*a*, between the arcuate support members 132*a*, 133*a*, where the same cut line defines the curved distal edge of the central support tab 140*a*.

The side panel 120*a* is connected to a bottom panel 124*a* along a discontinuous fold line 138*a*. A trapezoidal cut section 135*a* is located in the side panel 120*a*, extending from the discontinuous fold line 138*a*. An outer support tab 144*a* extends from the bottom panel 124*a* into the trapezoidal cut section 135*a* of the side panel 120*a*.

A glue tab 146*a* is joined to the bottom panel 124*a* along a tab fold line 150*a*. The glue tab 146*a* is rectangular in shape and located in-between two bottom support tabs 155*a*, 156*a*. A tab fold line 148*a* connects the bottom support tabs 155*a*, 156*a* to the bottom panel 124*a*. The tab fold line 148*a* is parallel to the tab fold line 150*a* connecting the glue tab 146*a* to the bottom panel 124*a*.

Assembly of the Alternate Embodiment

Referring now to FIGS. 9 and 10, the first step in the assembly process is to apply glue to glue areas 160*a*, 160*b*. The carrier blank 100' is folded along the discontinuous fold lines 138*a* and 138*b* so that the glue tab 146*a* is adhered to the central support strip 140*a* and the glue tab 146*b* is adhered to the central support strip 140*b* by contacting the glue areas 160*a*, 160*b*, respectively.

Next, glue is placed in glue areas 162*a*, 162*b* and 165*a*,*b* 166*a*,*b* as shown in FIG. 10. The carton blank 100' is then folded along the central fold line 112. This results in the handle panel 114*a* adhering to the handle panel 114*b* as well as the bottom support tabs 155*a*, 156*a* adhering to the opposite bottom support tabs 155*b*, 156*b*. The resulting assembly occupies very little space and therefore may be shipped efficiently to another location at which the carton may be erected and loaded.

Erecting and Loading the Carrier of the Alternate Embodiment

Figure 12:
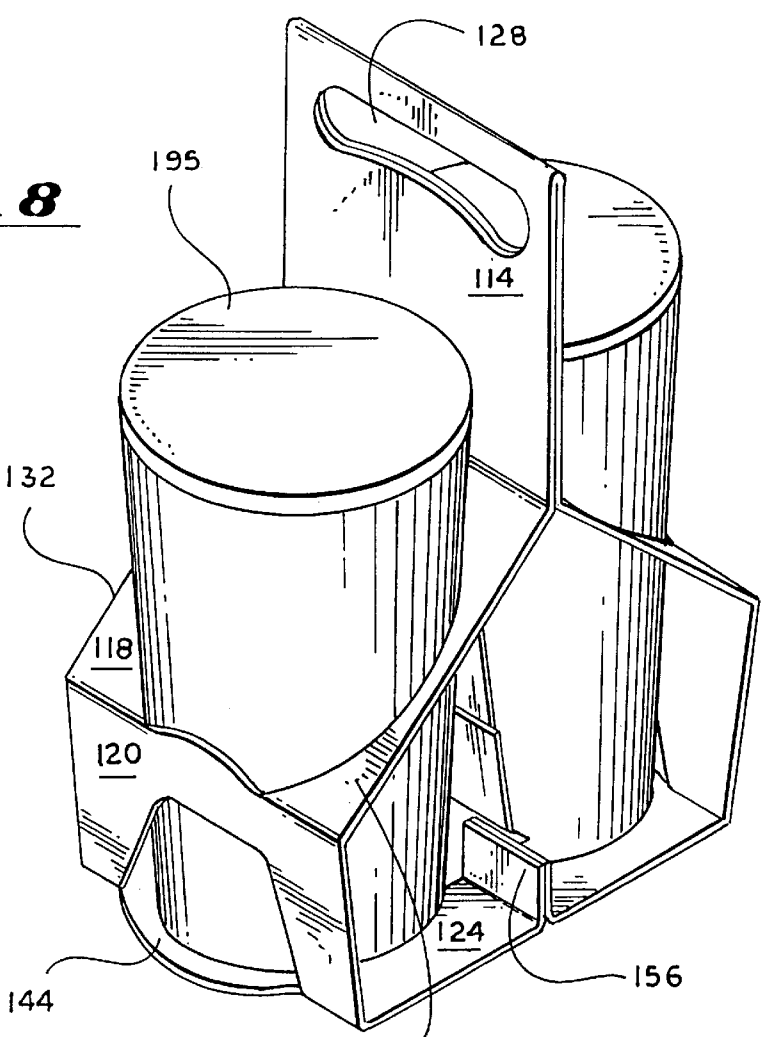
FIG. 12 is a pictorial view of a carrier of FIG. 8 with beverage containers.

It will be understood by those skilled in the art that the carrier 100 of the alternate embodiment can be erected and loaded, as shown in FIGS. 8 and 12, in a similar manner as the carrier 10, described above.

While the present invention has been described with particular reference to the preferred and alternate embodiments thereof, it should be understood that variations and modifications can be made without departing from the spirit and scope of the invention as defined in the appended claims.

What is claimed is:

1. A carrier for supporting containers, comprising:

a sleeve having a plurality of upper panels, a plurality of side walls connected to said upper panels, a bottom panel connected to said side walls, a plurality of receptacles located in said upper panels on opposite sides of a longitudinal center line of said sleeve;

a plurality of internal support members extending from said upper panels to said bottom surface at an angle towards said side panels, each of said internal support members comprising a support tab formed of material from said upper panels and bottom support legs formed of material from said bottom panel, said internal support member positioned to straddle the containers placed in said receptacles.

2. The carrier of claim 1 wherein said bottom support legs restrain the containers from movement in a direction substantially parallel to said longitudinal center line of said sleeve.

3. The carrier of claim 2 wherein each of said support tabs forms a tab head for engaging one of the containers forming a flexure fit restraining the container from movement in a direction perpendicular to said longitudinal center line of said sleeve.

4. The carrier of claim 3 wherein said tab head is provided for engaging one of the containers lower than or equal to the point where one of said side walls engages the container.

5. The carrier of claim 3 wherein each of said upper panels defines arcuate support members surrounding each of said receptacles, said arcuate support members further restraining the containers from movement in a direction substantially parallel to said longitudinal center line of said sleeve.

6. The carrier of claim 5 wherein said arcuate support members have first and second ends, said arcuate support members being wider at said first and second ends than at other points between said first and second ends to resist torque.

7. The carrier of claim 6 further comprising a handle attached to said upper panels.

8. The carrier of claim 6 further comprising a handle panel extending vertically from said upper panels, said handle panel including a handle opening in said handle panel.

9. The carrier of claim 8 wherein said plurality of side panels comprise a plurality of support braces, said support braces foldably connected to said side panels for engaging said bottom panel to hold said carrier open for loading.

10. The carrier of claim 6 further comprising a handle panel extending vertically from said upper panels, said handle panel including at least two handle openings in said handle panel.

11. The carrier of claim 10 wherein said handle openings are curved along a bottom of said handle opening to prevent engagement with a lid covering one of the containers when loading said carrier.

12. The carrier of claim 10 wherein said handle openings are angled downward along a bottom of said handle openings to prevent engagement with a lid covering one of the containers when loading said carrier.

13. The carrier of claim 10 further comprising a vertical cut line along said carrier between adjacent receptacles wherein said carrier may be broken along said cut line to produce multiple carriers.

14. A carrier formed from a generally rectangular blank, comprising:

a sleeve having a plurality of upper panels, a plurality of side walls connected to said upper panels, a bottom panel connected to said side walls, a plurality of receptacles located in said upper panels on opposite sides of a longitudinal center line of said sleeve; and a plurality of internal support members extending from said upper panels to said bottom panel at an angle towards said side panels, said internal support members positioned to straddle containers when placed in said receptacles, each of said internal support members comprising a central support tab formed of material from said upper panels and bottom support legs formed of material from said bottom panel.

15. The carrier of claim 14 wherein said internal support members are formed in a generally forked shape:

said bottom support legs for restraining the containers from movement in a direction substantially parallel to said longitudinal center line of said sleeve; and each of said upper panels defines arcuate support members surrounding said receptacles, said arcuate support members further restraining the containers from movement in a direction substantially parallel to said longitudinal center line of said sleeve.

16. A carrier for supporting containers, comprising:

a sleeve having a plurality of upper panels, a plurality if side walls connected to said upper panels, a bottom panel connected to said side walls, a plurality of receptacles located in said upper panels on opposite sides of a longitudinal center line of said sleeve;

a plurality of central support tabs formed of a material from said upper panels, each of said central support tabs extending downward from said upper panels for engaging one of the containers forming a flexure fit between said central support tab and said side wall opposite said central support tab; and a plurality of bottom support legs formed of material from said bottom panel, said bottom support legs extending upward and attached to said central support tabs.

17. The carrier of claim 16 wherein said bottom support legs connected to said central support tabs provide tensile strength to said carrier.

18. The carrier of claim 17 wherein each of said upper panels defines arcuate support members surrounding said receptacles, said arcuate support members restraining the containers from movement in a direction parallel to said longitudinal center line of said sleeve.

19. The carrier of claim 18 wherein said arcuate support members have first and second ends, said arcuate support members being wider at said first and second ends than at other points between said first and second ends to resist torque.

20. The carrier of claim 19 further comprising at least one handle attached to said upper panels.

21. The carrier of claim 19 further comprising a handle panel extending vertically from said upper panels, said handle panel including at least one handle opening in said handle panel.

22. The carrier of claim 21 wherein said handle openings are curved along a bottom of said handle openings to prevent engagement with a lid covering one of the containers when loading said carrier.

* * * * *